US007080835B2

(12) United States Patent
Oikawa et al.

(10) Patent No.: US 7,080,835 B2
(45) Date of Patent: Jul. 25, 2006

(54) SHEET DISCHARGING APPARATUS, AND SHEET TREATING APPARATUS AND IMAGE FORMING APPARATUS USING THE SHEET DISCHARGING APPARATUS

(75) Inventors: Atsuteru Oikawa, Chiba (JP); Hiroshi Suzuki, Ibaraki (JP); Yuichi Konno, Saitama (JP); Atsushi Takada, Ibaraki (JP)

(73) Assignees: Canon Finetech Inc., Mitsukaido (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/784,954

(22) Filed: Feb. 25, 2004

(65) Prior Publication Data

US 2004/0173960 A1 Sep. 9, 2004

(30) Foreign Application Priority Data

Mar. 7, 2003 (JP) ..... 2003-108395

(51) Int. Cl.
*B27F 7/17* (2006.01)

(52) U.S. Cl. ..... 271/208; 270/58.08

(58) Field of Classification Search ..... 271/208; 270/58.08

See application file for complete search history.

(56) References Cited

U.S. PATENT DOCUMENTS

| | | | | |
|---|---|---|---|---|
| 4,501,418 | A * | 2/1985 | Ariga et al. | 271/187 |
| 4,660,824 | A * | 4/1987 | Hermkens et al. | 271/208 |
| 4,741,524 | A * | 5/1988 | Bromage | 271/208 |
| 4,951,935 | A * | 8/1990 | Oikawa | 271/208 |
| 5,084,736 | A | 1/1992 | Suzuki et al. | 355/271 |
| 5,168,290 | A | 12/1992 | Tanaka et al. | 345/134 |
| 5,478,061 | A * | 12/1995 | Murakami et al. | 270/58.08 |
| 5,555,082 | A | 9/1996 | Tanaka et al. | 355/309 |
| 5,738,453 | A | 4/1998 | Tsuburaya et al. | 400/624 |
| 6,687,484 | B1 | 2/2004 | Oikawa | 399/406 |

FOREIGN PATENT DOCUMENTS

JP 9-48545 2/1997

* cited by examiner

*Primary Examiner*—Patrick Mackey
(74) *Attorney, Agent, or Firm*—Fitzpatrick, Cella, Harper & Scinto

(57) ABSTRACT

Disclosed is a sheet discharging apparatus including a charge eliminating member which is provided downstream a pair of swinging rollers for discharging a sheet, and is directed along a sheet discharging direction from its upstream side toward its downstream side. In the sheet discharging apparatus, the charge eliminating member is directed along the sheet discharging direction from its upstream side toward its downstream side, so that an area of the charge eliminating member facing a sheet is made larger than that of a conventional one, and static electricity of the sheet can be surely removed. Particularly, even when the sheet is a color sheet on which a color image charged with more static electricity than a monochromatic sheet is formed, the static electricity of the color sheet can be surely removed.

5 Claims, 9 Drawing Sheets

SHEET DISCHARGING APPARATUS, AND SHEET TREATING APPARATUS AND IMAGE FORMING APPARATUS USING THE SHEET DISCHARGING APPARATUS

BACKGROUND OF THE INVENTION

1. Field of the Invention

The present invention relates to a sheet discharging apparatus for discharging a sheet, and a sheet treating apparatus and an image forming apparatus each provided with the sheet discharging apparatus in its sheet discharging portion. Particularly, the present invention relates to a sheet treating apparatus and an image forming apparatus each capable of maintaining its charge elimination effect for a long time of period.

2. Related Background Art

In recent years, as an option for an image forming apparatus such as an electrophotographical copying machine and a laser beam printer, there have been developed sheet treating apparatuses such as a sorter for sorting image-formed sheets. Such a kind of sheet treating apparatus is made capable of executing at least one treatment of sheets, such as sorting, stapling or binding, and alignment.

In a sheet treating apparatus provided with a stapler for performing stapling with a needle, the stapling operation is performed on sheets conveyed into a main body of the sheet treating apparatus, after each of the sheet is passed through a conveyance path formed in the main body, and stacked on a tray for post-treatment.

The sheet treating apparatus for stapling a stack of sheets is adapted to stack sheets on the tray for post-treatment, and perform stapling of the sheets at a location, or at plural locations (normally at two locations) by moving the stapler serving as a stapling unit. During the stapling operation, it is impossible to stack sheets for next job on the tray for post-treatment. Accordingly, it is necessary to set an interval between sheets of different job units on which the stapling operation is to be executed.

However, in the event that the interval is set between the sheets, productivity lowers. In other words, the number of sheets capable of being treated per unit time decreases. As a sheet treating apparatus for preventing such decrease in the productivity, there has been proposed a sheet treating apparatus as illustrated in FIG. 9 (see Japanese Patent Application Laid-Open No. 9-48545, for example).

In a conventional sheet treating apparatus 10 illustrated in FIG. 9, a buffer roller path 14 is provided halfway in a conveyance path 12 for conveying a sheet to a post-treatment tray 11. In the buffer roller path 14, the sheet is wound on a rotary buffer roller 13, and conveyance of the sheet to the post-treatment tray 11 is thus put under a stand-by condition. Further, in the sheet treating apparatus 10 illustrated in FIG. 9, in the event that sheets stacked in the post-treatment tray 11 are to be treated, these sheets are treated by a stapler or the like after their ends are aligned by a stopper. In the sheet treating apparatus 10 illustrated in FIG. 9, accordingly, sheets stacked in the post-treatment tray 11 after passed through the buffer roller path 14 or a straight path 20 are sandwiched between upper and lower rollers 18*a* and 18*b* provided in a bracket 19 rotatable about an axis 21, and are brought into contact with the stopper by rotations of these rollers. The thus-treated sheets are discharged into and stacked in a stack tray 23 by reverse rotations of the upper and lower rollers 18*a* and 18*b*.

Thus, in the conventional sheet discharging apparatus as illustrated in FIG. 9, where sheets are to be treated by the stapler or the like, the sheets are reciprocally conveyed in such a manner that they are conveyed leftward and discharged after they are once conveyed rightward.

In the conventional sheet treating apparatus 10 having the above-discussed construction, sheets conveyed from a pair of sheet discharging rollers 17 in a main body 16 of an image forming apparatus 15 are stored in the buffer roller path 14, and a stack of these sheets stored in the buffer roller path 14 is conveyed to the post-treatment tray 11, after stapling of a stack of preceding sheets on the post-treatment tray 11, for example, is finished, and the stack of sheets is discharged from the post-treatment tray 11 by pinching and rotating operation of the upper and lower rollers 18*a* and 18*b* in a pair of swinging rollers (oscillation rollers) 18. Therefore, conveyance intervals between sheets during the stapling operation need not be widened, and the decrease in the productivity can be hence prevented.

Sheets discharged to the stack tray 23 by the pair of swinging rollers 18 serving as the sheet discharging apparatus 19 are likely to be brought into close contact with each other due to static electricity generated by sliding contact with the pair of swinging rollers 18, and hence there is a possibility that it is difficult for a user to separate the sheets from each other. Further, in the event that discharged sheets are stacked under a curling condition due to the static electricity, there is a possibility that the sheet falls from the stack tray 23 by being pushed by its following sheet.

In the sheet treating apparatus 10, therefore, a charge eliminating member 24 is provided in the bracket 19 for holding the upper roller 18*a* of the pair of swinging rollers 18. The charge eliminating member 24 is brought into contact with a sheet when the bracket 19 is rotated in a counterclockwise direction about the axis 21 to sandwich the sheet between the upper and lower rollers 18*a* and 18*b*. The static electricity stored in the sheet is hence grounded.

However, the charge eliminating member 24 provided in the sheet discharging apparatus of the conventional sheet discharging apparatus 10 is generally an elastic thin metal plate, or an elastic piece, such as an elastic print board, with a metal foil bonded thereto.

Accordingly, the charge eliminating member cannot securely remove the static electricity since only its tip portion having a small area is brought into contact with the sheet. If its contact area or its contact pressure is increased to surely remove the static electricity, there is a fear that the charge eliminating member hurts the sheet.

With the conventional charge eliminating member, therefore, it is difficult that the contact area or the contact pressure is so adjusted as to surely remove the static electricity without hurting the sheet.

Further, where the sheet discharging apparatus is provided in the above-discussed sheet treating apparatus, the charge eliminating member is reciprocally flexed each time the sheet is discharged by the above-discussed reciprocal movement of the sheet. As its result, the charge eliminating member is liable to deform or lose its elasticity, and hence there is a fear that the charge eliminating member cannot be securely brought into contact with the sheet, and the charge elimination effect lowers.

SUMMARY OF THE INVENTION

It is an object of the present invention to provide a sheet discharging apparatus capable of maintaining its charge elimination effect for a long period of time.

Further, it is an object of the present invention to provide a sheet treating apparatus which is provided with a sheet discharging apparatus capable of maintaining its charge elimination effect for a long period of time, so that its sheet stacking characteristic in a sheet stacking portion can be improved, and a user can readily handle a sheet.

To achieve the above object, a sheet treating apparatus according to the present invention is provided with a charge eliminating member disposed downstream a sheet discharging unit for discharging a sheet with its tip portion being directed along a sheet discharging direction from its upstream side toward its downstream side.

In the sheet treating apparatus according to the present invention, the charge eliminating member is capable of establishing contact with end portions of sheets stacked in a sheet stacking unit which can ascend and descend, and in which sheets discharged by the sheet discharging unit are stacked.

In the sheet treating apparatus according to the present invention, the charge eliminating member is disposed a predetermined distance away from a surface of a sheet being discharged by the sheet discharging unit.

To achieve the above object, a sheet treating apparatus according to the present invention is provided with a sheet treating unit for treating a sheet, and a sheet discharging apparatus for discharging a sheet treated by the sheet treating unit, which is the above-described sheet discharging apparatus.

To achieve the above object, an image forming apparatus according to the present invention is provided with an image forming unit for forming an image on a sheet, and a sheet discharging apparatus for discharging a sheet on which an image is formed by the image forming unit, which is the above-described sheet discharging apparatus.

In the sheet discharging apparatus according to the present invention, the charge eliminating member is directed along the sheet discharging direction from its upstream side toward its downstream side, so that an area of the charge eliminating member facing a sheet is wider than that of a conventional one, and static electricity stored in the sheet can be surely removed. Particularly, even when the sheet is a color sheet on which a color image charged with more static electricity than a monochromatic sheet is formed, the static electricity of the color sheet can be surely removed.

These and further aspects and features of the invention will become apparent from the following detailed description of preferred embodiments thereof in conjunction with the accompanying drawings.

DESCRIPTION OF THE PREFERRED EMBODIMENTS

Embodiments of a sheet discharging apparatus according to the present invention, a sheet treating apparatus provided with the sheet discharging apparatus, and a copying machine which exemplifies an image forming apparatus provided with the sheet treating apparatus will be described with reference to the drawings. The image forming apparatus represents a copying machine, a facsimile machine, a printer, their composite machine, and the like. Accordingly, the image forming apparatus provided with the sheet treating apparatus is not limited to the copying machine.

Further, the sheet discharging apparatus can be provided not only at a sheet discharging portion of the sheet treating apparatus, but also at a sheet discharging portion of an image forming apparatus without the sheet treating apparatus.

The scope of the present invention is not limited to sizes, numerals, materials, shapes, relative positional arrangements, and so forth of components described in the following embodiments otherwise specific description is particularly made.

In the following description of the embodiments, the sheet treating apparatus is an independent apparatus that is optionally detachably attachable to a main body of the image forming apparatus. The sheet treating apparatus, however, can also be integrally provided in the image forming apparatus, but its description is omitted because its function is the same as that of the sheet treating apparatus discussed in the following.

Figure 1:
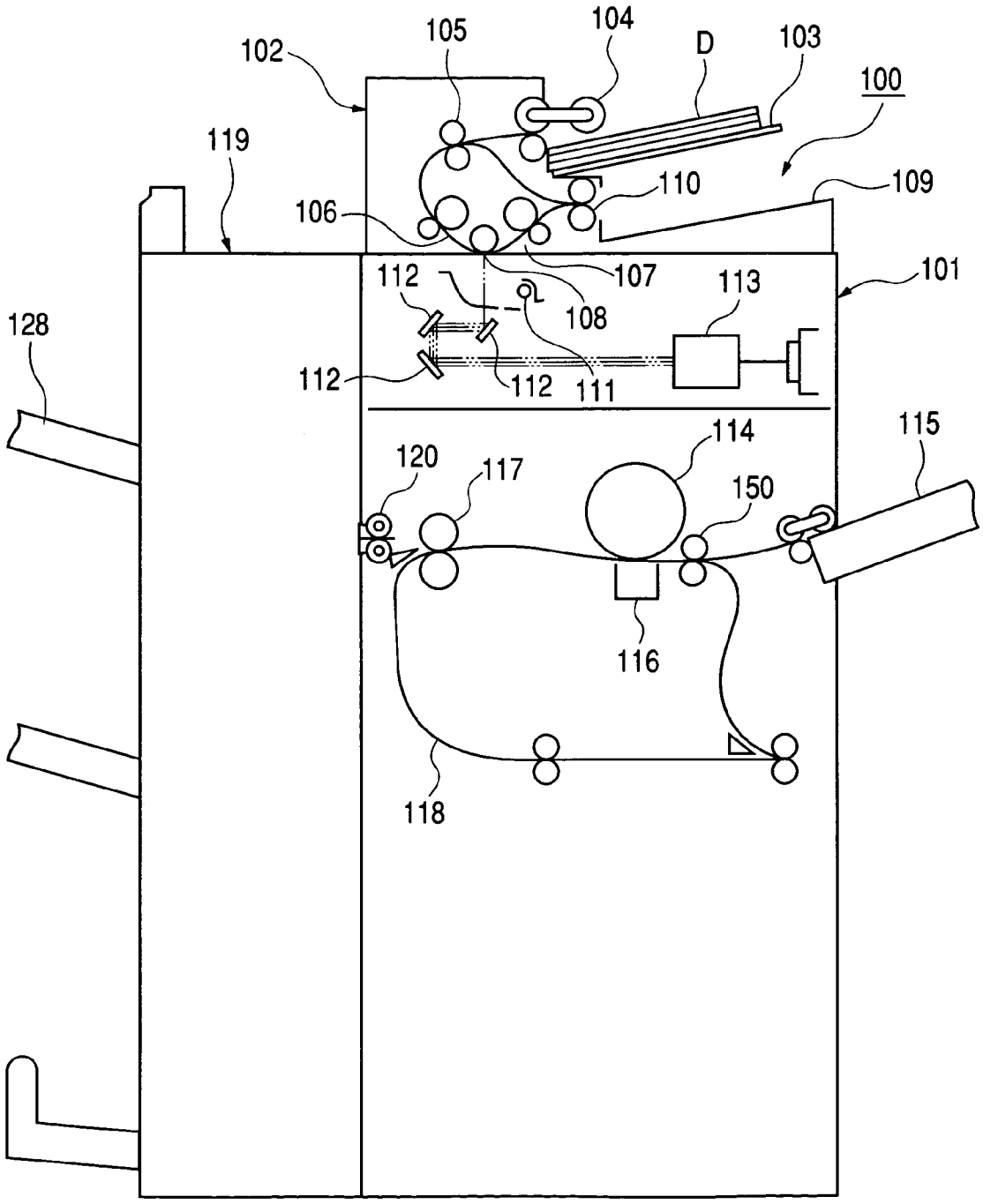
FIG. 1 is a front cross-sectional view schematically illustrating a copying machine which is an image forming apparatus having in its main body a sheet treating apparatus provided with a sheet discharging apparatus of an embodiment according to the present invention.

FIG. 1 is a cross-sectional view illustrating the schematic structure in which a sheet treating apparatus is attached to a copying machine. Specifically, the sheet treating apparatus is a finisher, for example.

(Image Forming Apparatus)

A copying machine 100 is comprised of a main body 101 of an apparatus, and a sheet treating apparatus 119. An original feeding apparatus 102 is mounted on an upper portion of the main body 101. Originals D are put on an original supporting portion 103 by a user, and each is sequentially separated one by one from the other sheets by a feeding portion 104, and supplied to a pair of registration rollers 105. Then, the original D is once stopped by the pair of registration rollers 105, and its skew feeding is corrected by formation of its loop. The original D is then passed through a guiding path 106 and a reading position 108 such that an image formed on the surface of the original can be read. The original D having passed through the reading position 108 is passed through a discharging path 107, and is discharged onto a discharging tray 109.

Further, in the event that front and rear surfaces of an original are to be read, an image on one surface of the original is initially read by the above-discussed passage of the original D through the reading position 108. The original D is then passed through the discharging path 107, and is conveyed by a pair of reverse rollers 110 in a switch-back manner. Thus, the original is again fed to the pair of registration rollers 105 under a condition under which front and rear surfaces of the original are reversed.

Similar to the reading of the image on one surface of the original D, skew feeding of the original is corrected by the pair of registration rollers 105, and the original is passed through the guiding path 106. An image on the other surface of the original is thus read at the reading position 108. The original D is then passed through the discharging path 107, and is discharged onto the discharging tray 109.

On the other hand, the image on the original passing through the reading position 108 is illuminated with light from an illumination system 111. Light reflected by the original is guided to an optical device 113 (a CCD or other devices) by a mirror 112. Image data can be thus obtained. A photosensitive drum 114 serving as an image forming unit, for example, is illuminated with laser light based on the above image data, and a latent image is accordingly formed on the photosensitive drum 114. Although not shown, it is possible to construct a structure in which the reflective light is applied directly to the photosensitive drum 114 by the mirror 112 to form the latent image on the photosensitive drum 114.

The latent image formed on the photosensitive drum 114 is converted into a toner image by a toner supplied from a toner supplying apparatus (not shown). Recording materials of sheets, such as papers or plastic films, are stacked on a cassette 115. The sheet is fed out from the cassette 115 in accordance with a recording signal, and is introduced into a location between the photosensitive drum 114 and a transferring device 116 by a pair of registration rollers 150 with its introduction timing being adjusted. The toner image on the photosensitive drum 114 is then transferred to the sheet by the transferring device 116. The toner image on the sheet is fixed by thermally pressing the sheet by a fixing device 117 during passage of the sheet through the fixing device 117.

In the event that images are to be formed on opposite surfaces of the recording material, respectively, a sheet, on one surface of which an image is fixed by the fixing device 117, is again fed into the location between the photosensitive drum 114 and the transferring device 116 through an opposite-surface path 118 provided downstream the fixing device 117. Thus, a toner image is also transferred to the rear surface of the sheet. The toner image is thus fixed by the fixing device 117, and the sheet is discharged outside (to a side of the finisher 119).

Figure 2:
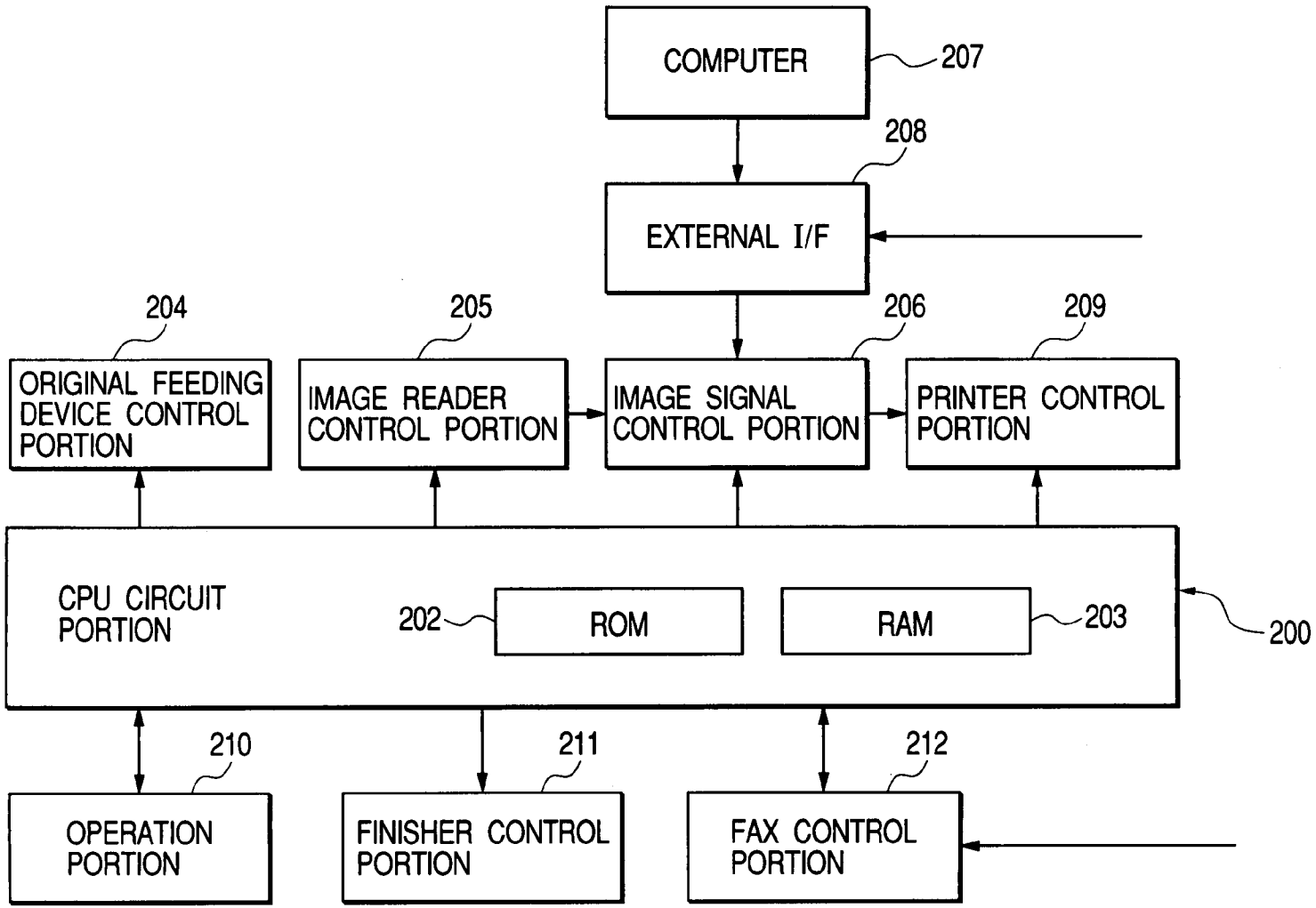
FIG. 2 is a control block diagram of the copying machine of FIG. 1.

FIG. 2 is a control block diagram illustrating the overall copying machine. The overall copying machine 100 is adapted to be controlled by a CPU circuit portion 200. The CPU circuit portion 200 includes a ROM 202 for storing sequences of individual portions (i.e., control procedures), and a RAM 203 for temporarily storing various information when necessary. An original feeding device control portion 204 is adapted to control the original feeding operation of the original feeding apparatus 102. An image reader control portion 205 is adapted to control reading of the original by controlling the illumination system 111 and the like. An image signal control portion 206 is adapted to receive reading information from the image reader control portion 205, or receive image information supplied from an external computer 207 through an external I/F 208, process this information, and supply the processed signal to a printer control portion 209. The printer control portion 209 is adapted to control the photosensitive drum 114 and the like based on the processed image signal supplied from the image signal control portion 206 such that an image can be formed on a sheet.

An operation portion 210 is adapted to receive information of a sheet size at the time a user uses the copying machine, and information of which treatment is to be executed to the sheet (for example, information of stapling treatment), and is also adapted to indicate information of operation conditions and the like of the main body 101 of the copying machine, and the finisher 119 serving as a sheet post-treatment apparatus. A finisher control portion 211 is adapted to control the operation in the finisher 119 serving as the sheet post-treatment apparatus. A FAX control portion 212 is adapted to control the copying machine such that the copying machine can be used as a facsimile machine, and transmission and reception of a signal can be conducted together with another facsimile machine.

(Sheet Treating Apparatus)

Figure 3:
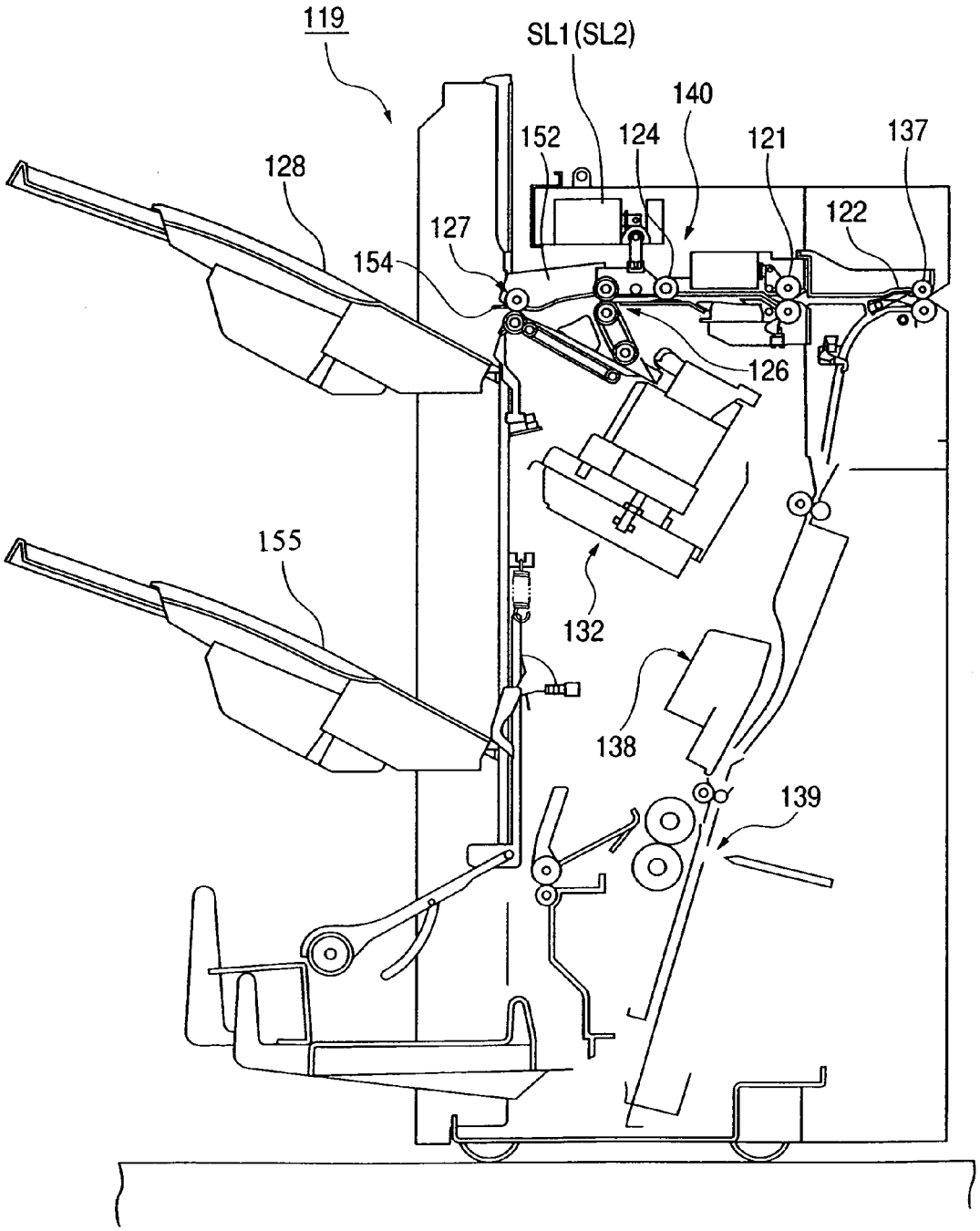
FIG. 3 is a front cross-sectional view schematically illustrating the sheet treating apparatus of FIG. 1.

FIG. 3 is a longitudinal cross-sectional view illustrating the sheet treating apparatus. FIG. 2 is the control block diagram of the sheet treating apparatus.

As illustrated in FIG. 3, the sheet treating apparatus has a function of binding a stack of sheets, and is provided with a stapler unit 132 for binding or stapling a portion near an edge of the stack of sheets, a stapler 138 for stapling a central portion of the stack of sheets, a bending unit 139 for bending or folding a bound portion of the stack of sheets stapled by the stapler 138 to make a book-like stack of sheets, and so forth.

The sheet treating apparatus 119 also includes a buffer unit 140 for stacking a plurality of sheets under a straightly extending condition, and storing (buffering) them at the time of the operation of the stapler 132.

Figure 9:
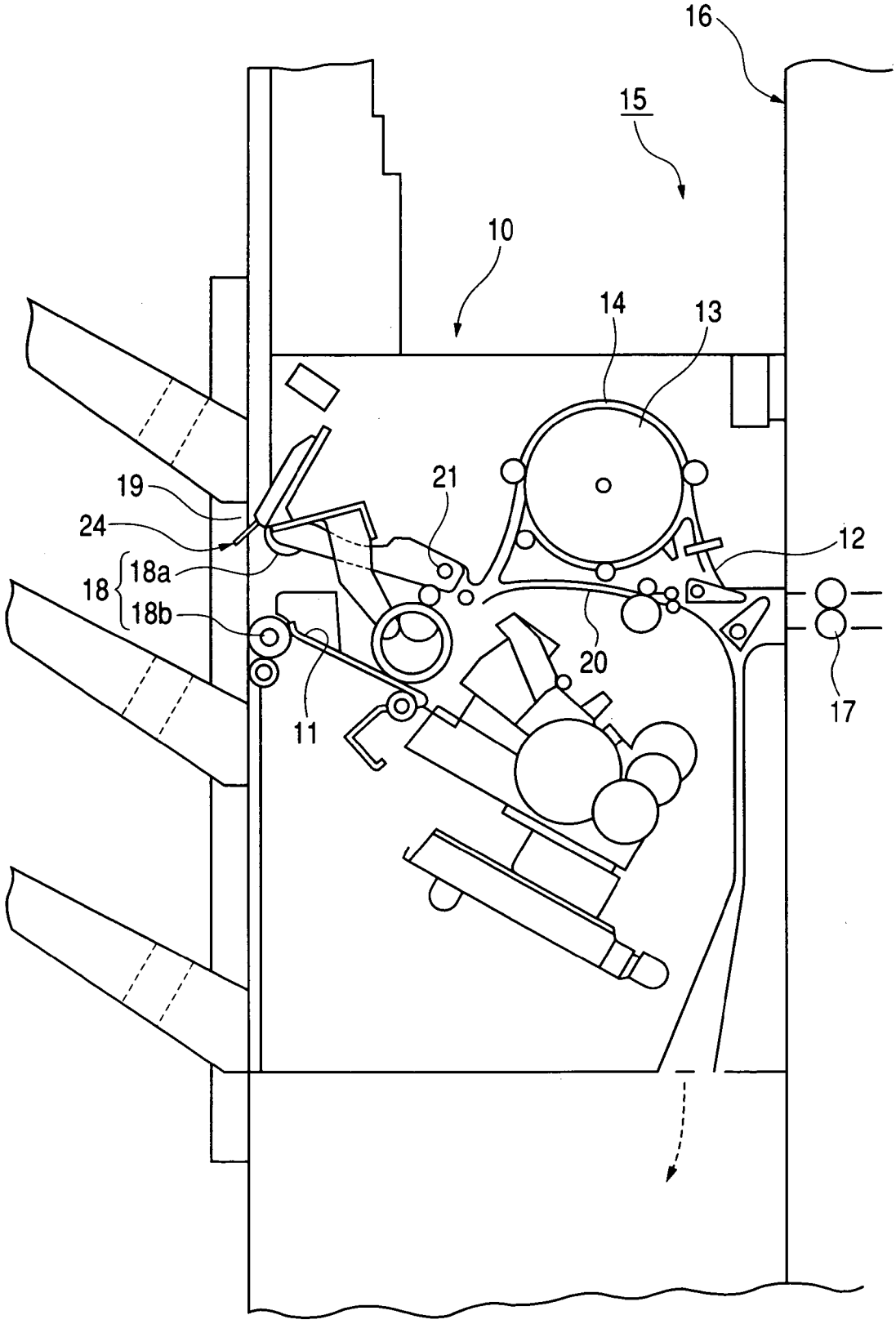
FIG. 9 is a front cross-sectional view schematically illustrating a conventional sheet treating apparatus.

Since the buffer unit 140 is adapted to stack sheets under the straightly extending condition, and store them, it is possible to shape the buffer unit 140 into a flat configuration, differently from a conventional mechanism including the buffer roller 13 as illustrated in FIG. 9, for example. The sheet treating apparatus can be hence made small in size, and light in weight. Further, since a sheet can be stored under the straightly extending condition, the sheet will not be rounded, differently from the case of the buffer roller. Accordingly, the sheet can be readily handled, so that treatment time of the sheet by the sheet treating apparatus can be shortened.

Figure 4:
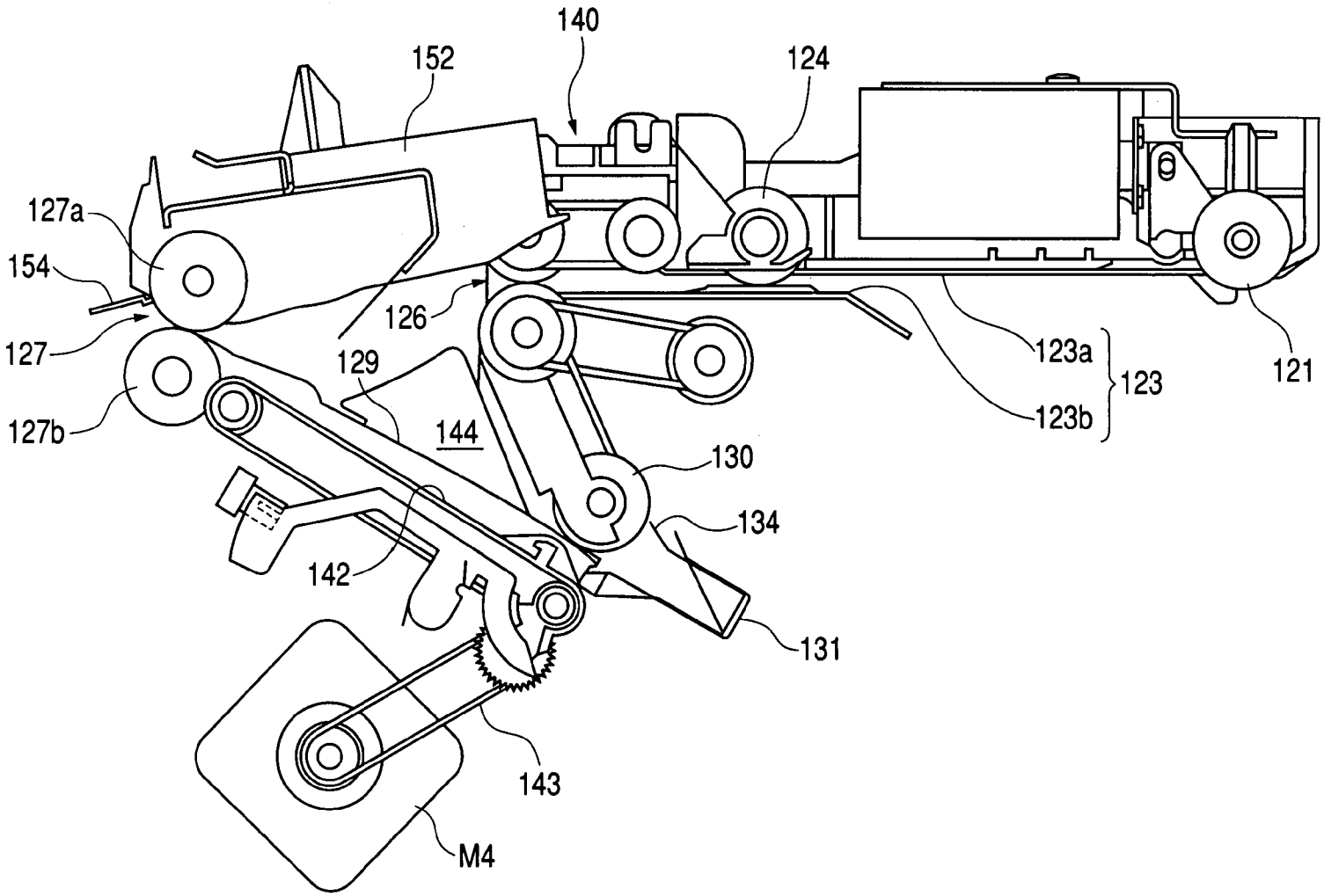
FIG. 4 is an enlarged view illustrating a main portion of the sheet treating apparatus of the embodiment of FIG. 2.
Figure 5:
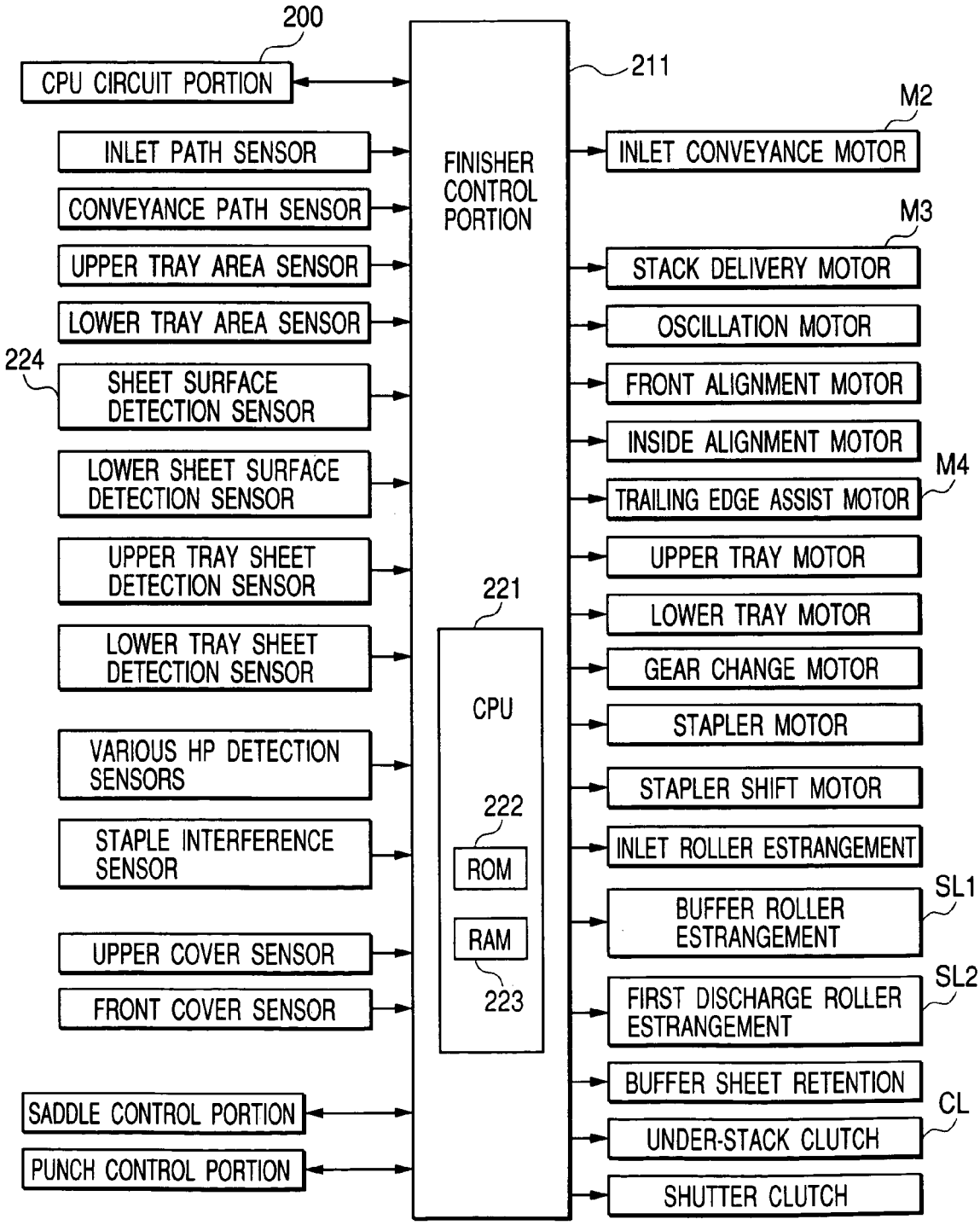
FIG. 5 is a control block diagram of the sheet treating apparatus of FIG. 3.

The sheet treating apparatus 119 is adapted to be controlled by the finisher control portion 211 illustrated in FIGS. 2 and 5. In a CPU 221 of the finisher control portion 211, there are provided a ROM 222 for storing a control procedure (a sequence) of the sheet treating apparatus 119 operative based on an instruction from the CPU circuit portion 200 in the main body of the copying machine, and the like, and a RAM 223 for temporarily storing information for controlling the sheet treating apparatus 119 when necessary, and so forth. Further, a sheet surface detection sensor 224 operative based on motion of a sheet surface detecting lever (described later) is connected to the finisher control portion 211. The CPU 221 is adapted to control ascent and descent of a stack tray 128 based on a sheet detection signal of the sheet surface detection sensor 224. The finisher control portion 211 is adapted to control, based on the above-discussed sequence, operations of an inlet conveyance motor M2 for rotating a pair of inlet rollers 121, a buffer roller 124, and a pair of first discharge rollers, a stack delivery motor M3 for rotating a pair of swinging rollers (or oscillation rollers) 127 and a return roller 130 (see FIG. 4), an understack clutch CL for establishing or pausing transmission of rotation of the stack delivery motor M3 to a lower roller 127*b* (see FIG. 4), and so forth.

It is possible to construct the CPU circuit portion 200 and the finisher control portion 211 (see FIG. 2) in a united form.

In the event that a user selects the sheet stapling treatment indicated on the operation portion 210 (see FIG. 2) of the copying machine 100, the CPU control portion 200 controls the individual portions in the main body such that copying operation of the copying machine can be established and the sheet stapling treatment signal can be supplied to the finisher control portion 211.

The sheet treating apparatus 119 executes the buffer operation based on the buffer operation instruction of the finisher control portion 211 at the time when the CPU circuit portion 200 in the main body 101 judges that the interval at which sheets are fed from the main body 101 of the copying machine 100 is shorter than the sheet stapling treatment time.

Further, the sheet treating apparatus 119 is adapted to cause a trailing edge assist 134 (see FIG. 4) to push the trailing edge of a stack of sheets. Where the trailing edge assist 134 thus pushes the trailing edge of the stack of sheets to convey the stack of sheets, it is possible to surely transport the stack of sheets without hurting the surface thereof, differently from a case where the stack of sheets is discharged by rotation and pressure of a roller against the surface of the stack of sheets.

Figure 6:
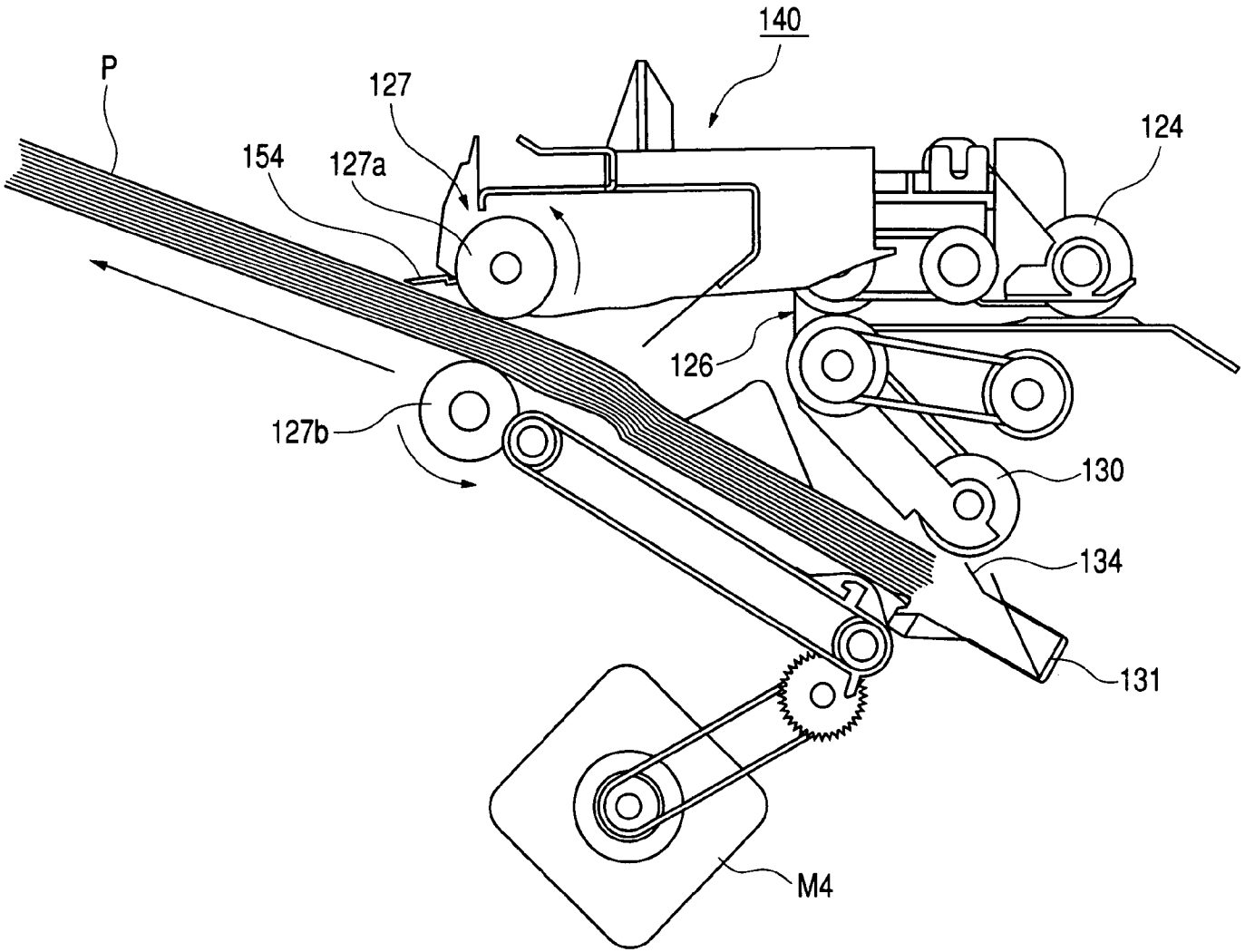
FIG. 6 is a view explaining the problem occurring where a stack of sheets is conveyed only by a pair of swinging rollers.

In other words, in the event that the stack of sheets is discharged only by the pair of swinging rollers 127 as illustrated in FIG. 6, there is a possibility to cause a shift between an upper sheet and a lower sheet since the conveyance amount is likely to differ between the sheets due to a difference in friction against the sheet between the upper roller 127*a* and the lower roller 127*b*, a difference in rotation speed therebetween, and the like. In such a case, it is likely that the pair of swinging rollers 127 is rotated in a sliding manner against the sheet, and the sheet is hurt. Further, it is likely that the overall stack of sheets is discharged while being twisted, and the stack of sheets cannot be smoothly discharged, leading to prolongation of treatment time. Furthermore, in the event that the stack of sheets is entirely twisted, there is a fear that the stack of sheets is split at its bound portion, and the stack of sheets becomes unusable.

Further, such phenomena are more likely to occur, in the event that pinching pressure of the pair of swinging rollers 127 against the stack of sheets is enhanced such that the stack of sheets can be surely discharged. Conversely, if the pinching pressure is weakened, it is likely that the stack of sheets cannot be securely conveyed. Accordingly, it is difficult to set the pinching pressure of the pair of swinging rollers 127.

In contrast to the above structure, the sheet treating apparatus is so designed that a stack of sheets can be discharged not only by the pair of swinging rollers 127, but also by the trailing edge assist 134. Therefore, it is possible to eliminate the above-discussed sliding rotation of the pair of swinging rollers 127 against the sheet, and the twist of the stack of sheets, so that the stack of sheets can be smoothly and quickly discharged without hurting or damaging the sheet and the stack of sheets. Furthermore, the stack of sheets can be discharged without strictly managing the pinching pressure of the pair of swinging rollers 127.

(Sheet Discharging Apparatus)

Figure 7:
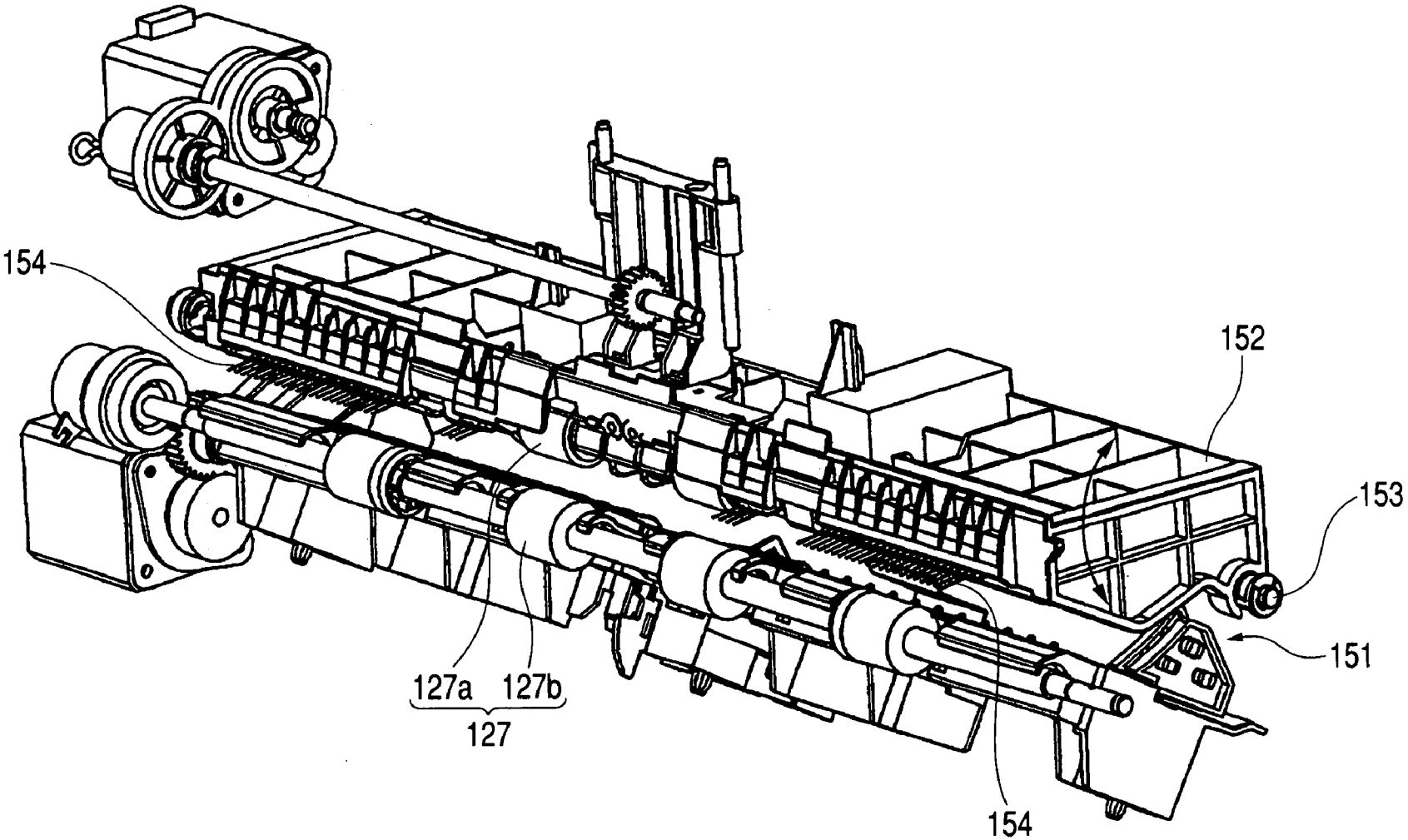
FIG. 7 is a perspective view illustrating a sheet treating apparatus of an embodiment according to the present invention.
Figure 8:
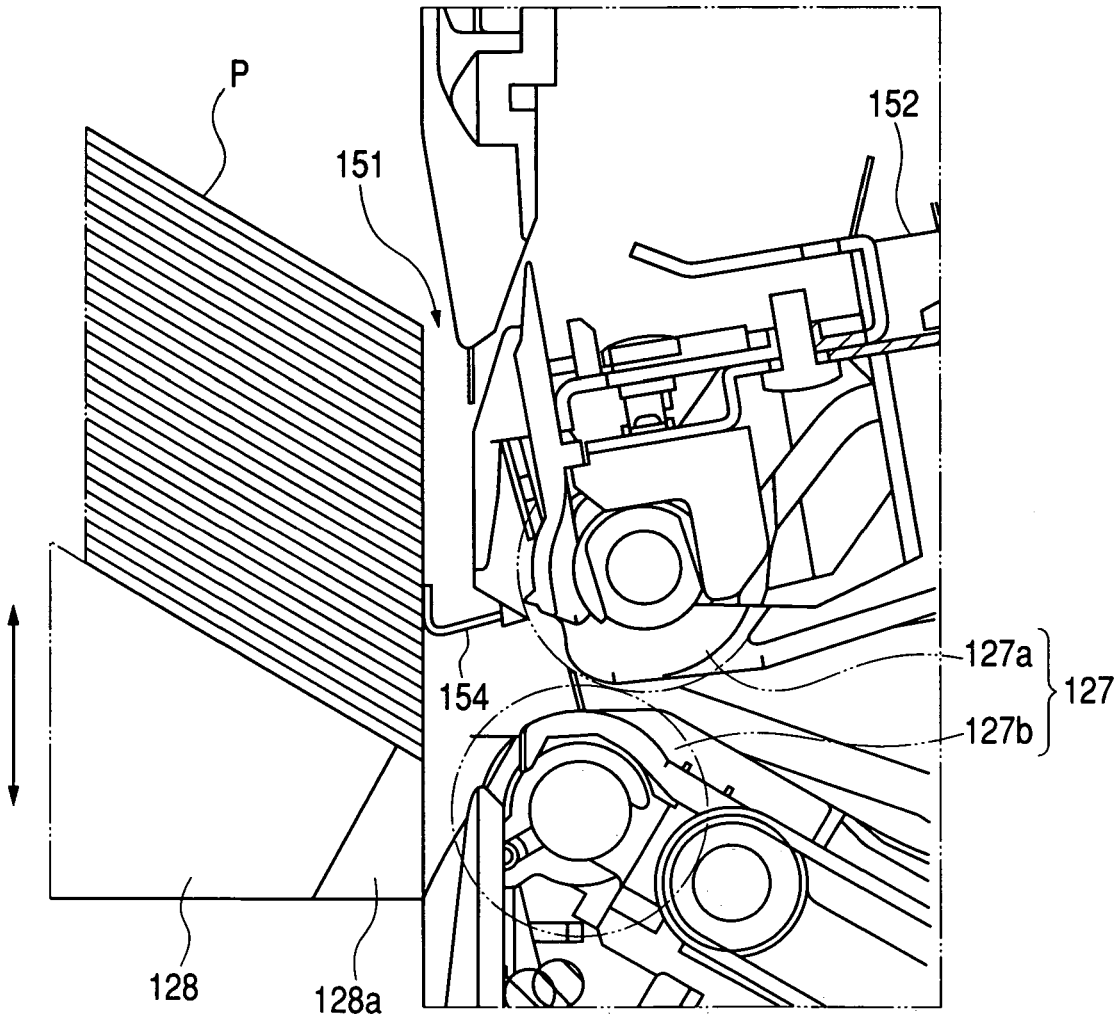
FIG. 8 is a front view illustrating a sheet treating apparatus of an embodiment according to the present invention.

The sheet discharging apparatus of this embodiment will now be described. In FIGS. 3, 4, 6 and 8, a bracket 152 provided with the upper roller 127*a* of the pair of swinging rollers 127 serving as a sheet discharging unit, for example, is adapted to swing up and down about an axis 153 (see FIG. 7). Downstream the upper roller 127*a* of the bracket 152, there are provided a plurality of charge eliminating needles 154 serving as the charge eliminating member, for example. The charge eliminating needle 154 has elastic characteristic, and is directed along a discharging direction of the sheet to be discharged by the pair of swinging rollers 127, from its upstream side toward its downstream side. Further, the charge eliminating needle 154 is disposed along the sheet discharging direction with being a predetermined distance spaced from the sheet such that static electricity in the sheet can be discharged by the charge eliminating needle under a condition under which the upper roller 127*a* is brought into contact with the lower roller 127*b*. Furthermore, the charge eliminating needle 154 has such a length that it can be in contact with sheets P stacked on the stack tray 128 serving as the sheet stacking unit, for example, as illustrated in FIG. 8. The charge eliminating needle 154 is grounded.

In the thus-constructed sheet discharging apparatus 151 of this embodiment, the charge eliminating needle 154 is directed along the sheet discharging direction from its upstream side toward its downstream side, so that its area facing the sheet can be made wider than a conventional one, and static electricity of the sheet can be surely removed. Particularly, even when the sheet is a color sheet on which a color image charged with more static electricity than a monochromatic sheet is formed, the static electricity of the color sheet can be surely removed.

Further, in the thus-constructed sheet discharging apparatus 151 of this embodiment, the charge eliminating needle 154 is disposed at a location close to, but not in contact with the sheet to be discharged by the pair of swinging rollers 127 such that static electricity can be discharged from the sheet. Accordingly, the charge eliminating needle 154 can be used for a long period of time. Additionally, the charge elimination effect can be maintained for a long period of time.

Moreover, in the sheet discharging apparatus 151, the charge eliminating needle 154 is adapted to achieve discharge of static electricity from the sheet without being in contact with the sheet, even when the pair of swinging rollers 127 is reciprocally moved. Accordingly, the charge eliminating needle 154 is usable for a long term, and the charge elimination effect can also be maintained for a long term.

Although the charge eliminating needle 154 is disposed facing the upper surface of a sheet in this embodiment, it can be disposed facing the lower surface of the sheet. Further, although the charge eliminating needle 154 is disposed apart from a sheet such that discharge of static electricity can be achieved between the charge eliminating needle 154 and the sheet, the charge eliminating needle 154 can be disposed in contact with the sheet so long as its tip portion is directed along the sheet discharging direction from its upstream side to its downstream side. Even in such a case, the charge elimination effect can be maintained for a long time, equivalently to the non-contact case.

In FIG. 3, in the event that the uppermost stack tray 128 is lifted such that sheets can be stacked on an upper stack tray 155 next to the uppermost one, sheets on the uppermost stack tray pass near the pair of swinging rollers 127 at a sheet discharge port. In this event, the charge eliminating needle 154 can come into contact with the trailing edges of sheets P stacked as illustrated in FIG. 8, and can achieve charge elimination of the sheets, since the charge eliminating needle 154 has such a length that it can touch the trailing edges of sheets P stacked on the stack tray 128. In this case, charge elimination of the sheet is performed twice in the sheet discharging apparatus, so that its static electricity can be assuredly removed.

Further, there is a possibility that the stack tray 128 ascends for the purpose of receiving sheets from the sheet discharge port (not shown) provided above the pair of swinging rollers 127. Even in such a case, the charge eliminating needle 154 can come into contact with the sheet, and can eliminate static electricity of the sheet.

An escape portion 128*a* can be formed in the stack tray 128 to avoid its contact with the charge eliminating needle 154. When the escape portion 128*a* is formed, the charge eliminating needle 154 only comes into contact with sheets stacked on the stack tray 128, but does not touch the stack tray 128. Further, in the event that the stack tray 128 in an empty state ascends, the charge eliminating needle 154 does not touch the stack tray. Resultantly, the charge eliminating needle 154 can be used for a long term.

In the sheet treating apparatus provided with the above-discussed sheet discharging apparatus, there is provided the buffer unit 140 for stacking and storing (buffering) plural sheets under the straightly extending condition at the time of the operation of the stapler unit 132. The present invention is, however, applicable to a case where a buffer unit provided with the buffer roller 13 and the buffer roller path 14 as illustrated in FIG. 9 is arranged in place of the buffer unit 140. Thus, the present invention is not limited to the sheet treating apparatus including the buffer unit 140 for stacking and storing (buffering) plural sheets under the straightly extending condition.

Further, the sheet discharging apparatus can be attached to a main body of an image forming apparatus without the sheet treating apparatus. Specifically, in FIG. 1, the sheet discharging apparatus can be disposed downstream a pair of discharging rollers 120 in the main body 101 of the copying machine 102 without the sheet treating apparatus 119.

Although the position of a sheet is detected by the sensor in the foregoing description, it is possible to judge the position of the sheet by sheet holding information (memory information) which is managed in the CPU 221.

Further, in the sheet treating apparatus, a stack of sheets is bound after width alignment and trailing edge alignment for performing alignment from opposite ends of the stack of sheets on a treatment tray 129 are accomplished, but the stack of sheets can be discharged into the stack tray 128 without being bound, and with its width and trailing end alignments being only executed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet discharging apparatus comprising:

a sheet discharging unit which discharges a sheet from a sheet discharge port of said sheet discharging unit;

a charge eliminating member which is disposed at said sheet discharge port, and which eliminates static electricity in the sheet discharged from said sheet discharge port; and a sheet stacking unit, being able to ascend and descend passing said sheet discharge port, on which the sheet discharged by said sheet discharging unit is stacked, wherein said charge eliminating member is disposed so that its tip portion is directed along the sheet discharging direction from an upstream side toward the downstream side of the sheet discharging direction, and wherein said charge eliminating member is contactable with an end of the sheet stacked on said sheet stacking unit.

2. A sheet discharging apparatus according to claim 1, wherein said sheet stacking unit comprises a stacking tray, and wherein said sheet stacking tray has an escape portion which avoids contact with said charge eliminating member.

3. A sheet discharging apparatus according to claim 1, wherein said charge eliminating member is disposed a predetermined distance away from said surface of the sheet being discharged.

4. A sheet treating apparatus comprising:

a sheet treating unit which treats a sheet; and a sheet discharging apparatus which discharge the sheet treated by said sheet treating unit;

wherein said sheet discharging apparatus is a sheet discharging apparatus recited in any one of claims 1 to 3.

5. An image forming apparatus comprising:

an image forming unit which forms an image on a sheet; and a sheet discharging apparatus which discharges the sheet on which an image is formed by said image forming unit;

wherein said sheet discharging apparatus is a sheet discharging apparatus recited in any one of claims 1 to 3.

* * * * *

UNITED STATES PATENT AND TRADEMARK OFFICE

CERTIFICATE OF CORRECTION

PATENT NO. : 7,080,835 B2
APPLICATION NO. : 10/784954
DATED : July 25, 2006
INVENTOR(S) : Atsuteru Oikawa et al.

It is certified that error appears in the above-identified patent and that said Letters Patent is hereby corrected as shown below:

COLUMN 1:
Line 15, “time” should read --period--.
Line 16, “period.” should read --time.--.
Line 28, “sheet” should read --sheets--.

COLUMN 5:
Line 52, “information” should read --pieces of information--.

COLUMN 9:
Line 12, “Resultantly,” should read --As a result,--.

COLUMN 10:
Line 35, “discharge” should read --discharges--.
Line 36, “unit;” should read --unit,--.
Line 44, “units;” should read --unit,--.

Signed and Sealed this

Tenth Day of April, 2007

JON W. DUDAS
*Director of the United States Patent and Trademark Office*